US012158017B1

(12) United States Patent
Hsu

(10) Patent No.: US 12,158,017 B1
(45) Date of Patent: Dec. 3, 2024

(54) STRUCTURAL IMPROVEMENT OF SIDE POST OF FENCE

(71) Applicant: Xia Shin International Co., Ltd., Tainan (TW)

(72) Inventor: Chin-Hung Hsu, Tainan (TW)

(73) Assignee: Xia Shin International Co., Ltd., Tainan (TW)

( * ) Notice: Subject to any disclaimer, the term of this patent is extended or adjusted under 35 U.S.C. 154(b) by 0 days.

(21) Appl. No.: 18/471,811

(22) Filed: Sep. 21, 2023

(30) Foreign Application Priority Data

Sep. 6, 2023 (TW) ..... 112133913

(51) Int. Cl.
*E04H 17/14* (2006.01)
*E04H 17/20* (2006.01)

(52) U.S. Cl.
CPC ..... *E04H 17/1465* (2021.01); *E04H 17/21* (2021.01)

(58) Field of Classification Search
CPC . E04H 17/14; E04H 17/1413; E04H 17/1417; E04H 17/1447; E04H 17/1465; E04H 17/20; E04H 17/21; E04H 17/22
See application file for complete search history.

(56) References Cited

U.S. PATENT DOCUMENTS 3,113,760 A * 12/1963 Huret ..... E04F 11/181 D25/129
6,467,756 B1 * 10/2002 Elsasser ..... E04H 17/1413 52/832
7,500,654 B2 * 3/2009 Rosaen ..... E04H 12/2215 256/65.01
7,802,351 B2 * 9/2010 McGinness ..... E04H 12/2253 29/458
8,113,473 B2 * 2/2012 Bradley ..... E04H 12/2253 248/545

(Continued)

FOREIGN PATENT DOCUMENTS

CA 2246502 A1 * 11/1999 ..... E04H 12/2215
GB 1262602 A * 2/1972

(Continued)

*Primary Examiner* — Jonathan P Masinick
(74) *Attorney, Agent, or Firm* — Best & Flanagan LLP

(57) ABSTRACT

A structural improvement of a side post of a fence, wherein the side post comprises a square side post tube and a reinforcing post located inside the side post tube. The four sides of the reinforcing post facing the side post tube are respectively configured with three longitudinal boards and a connecting board extending coaxially with the side post tube and arranged radially. An abutting board is connected to the external end of the connecting board, the abutting board extends coaxially with the side post tube and the board edge of each longitudinal board and the side of the abutting board contact with the tube internal wall of the side post tube. The board edge of each longitudinal board is configured with a notch corresponding to the connecting hole defined in the side post tube, the height of the notch is higher than hole height of the connecting hole, and the gap of the notch faces the connecting hole, thereby the reinforcing post not only enabling to reinforce the rigid strength but also the side post being capable of being used to connect the fences in linear, right-angle or T-shaped arrangement.

6 Claims, 11 Drawing Sheets

(56) References Cited

U.S. PATENT DOCUMENTS

| | | | | |
|---|---|---|---|---|
| 10,676,958 | B2 * | 6/2020 | Short | E04H 17/143 |
| 10,767,825 | B2 * | 9/2020 | Chia | E04C 3/36 |
| 10,954,687 | B2 * | 3/2021 | Dalton | E04H 17/1447 |
| 2017/0058557 | A1 * | 3/2017 | Wu | E04H 17/22 |
| 2019/0257110 | A1 * | 8/2019 | Powers, III | E04H 17/168 |

FOREIGN PATENT DOCUMENTS

| | | | | |
|---|---|---|---|---|
| GB | 2548625 A | * | 9/2017 | B65G 7/12 |
| TW | I804433 B | | 6/2023 | |

* cited by examiner

STRUCTURAL IMPROVEMENT OF SIDE POST OF FENCE

BACKGROUND OF THE INVENTION

The present invention relates to a structural improvement of a side post of a fence, and more particularly to a side post of a fence enabling to enhance the structural strength and facilitate a linear, vertical or T-shaped configuration and assembly for a fence.

DESCRIPTION OF THE RELATED ART

Accordingly, the prior U.S. Pat. No. 10,954,687B2 entitled "FENCE INSTALLATION METHOD" (hereinafter referred as "the prior art") is to install an I-beam reinforcing post at the interior of the side tubular post for reinforcing the rigidity of the side tubular post. Moreover, the longitudinal channels are configured on the left and right sides of the I-beam reinforcing post and the longitudinal channels face the connecting hole of the side tubular post to enable the end portion of the cross bar to be inserted into the longitudinal channel to position through the connecting hole. When the configuration position of the fence is a slanted ground surface, the reinforcing post provided with the longitudinal channel enables the cross bar to be adjusted depending on the angle of the ground surface to be slanted configuration, and the end portion of the cross bar remains to be positioned in the longitudinal channel.

The reinforcing post of the above prior art is I-beam and only the left and right sides are configured with the longitudinal channels, and therefore the cross bars can be just connected on the left and right sides of the side tubular post. The cross bars are not allowed to be further connected to the front and rear ends of the side tubular post because the front and rear ends of the reinforcing tubular post are configured with the longitudinal channels. Therefore, the prior fence is merely configured to be a linear connection but the right angle or T-shaped connection is not allowed.

In view of the drawback of the above prior art in application, the inventor of the present invention spent time and effort seeking solutions for improvement and finally developed the present invention

SUMMARY OF THE INVENTION

It is a primary objective of the present invention to provide a structural improvement of a side post of a fence enabling the fence to be a linear, right-angle or T-shaped arrangement and installation.

The primary feature of the present invention is to a side post comprises a square side post tube and a reinforcing post installed inside the side post tube and the four side tube walls of the reinforcing post facing the side post tube are respectively configured with three longitudinal boards and a connecting board extending coaxially with the side post tube and presenting in a radial arrangement, and the three longitudinal boards and the connecting board are arranged adjacently at a 90-degree angle. An abutting board is connected to the external end of the connecting board, wherein the abutting board extends coaxially with the side post tube and a board edge of each longitudinal board and a side face of the abutting board are touched with the internal wall of the side post tube. A notch is configured at the board edge of each longitudinal board, wherein the notch corresponds to a connecting hole defined on the tube wall of the side post tube for connecting the cross bar, the notch height is higher than the connecting hole height, and the gap of the notch faces the connecting hole, thereby the reinforcing post utilizing the abutting board to fixedly connect with the side post tube via a fixing component and then the rigidity strength of the side column tube being reinforced and one end of the cross end passing into the notch through the connecting holes and gap and further the cross bar being fixed with the side post tube via another fixing component to connect the cross bar with the side post, and moreover the connecting hole of each side wall of the longitudinal board facing the side post tube is configured with a notch so the side post can be used to connect fences in linear, right-angle or T-shaped arrangement.

Other features and advantages of the present invention will become apparent from the following description of the invention which refers to the accompanying embodiments and drawings.

DETAILED DESCRIPTION OF EMBODIMENTS OF THE INVENTION

Figure 1:
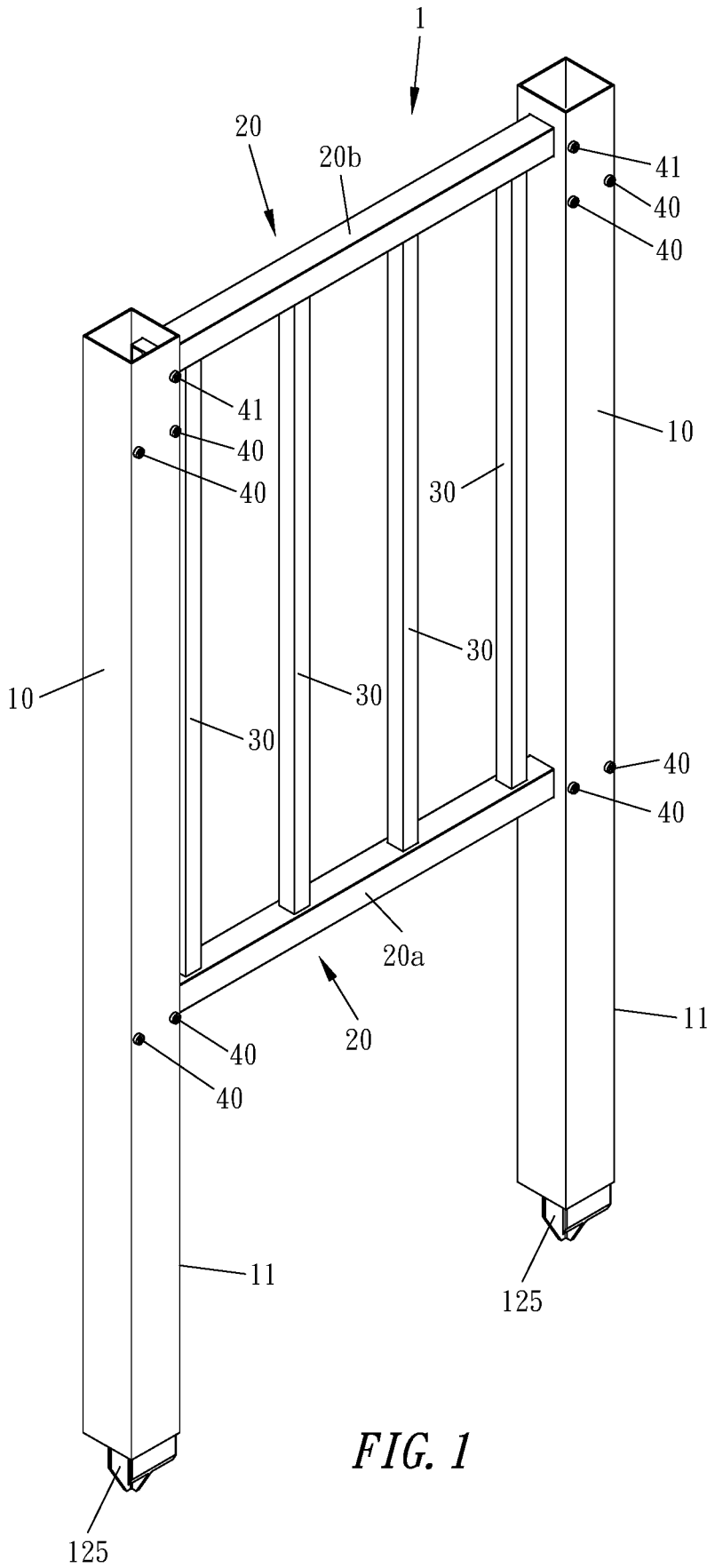
FIG. 1 is a perspective view of the combination of a single fence according to an embodiment of the present invention.
Figure 2:
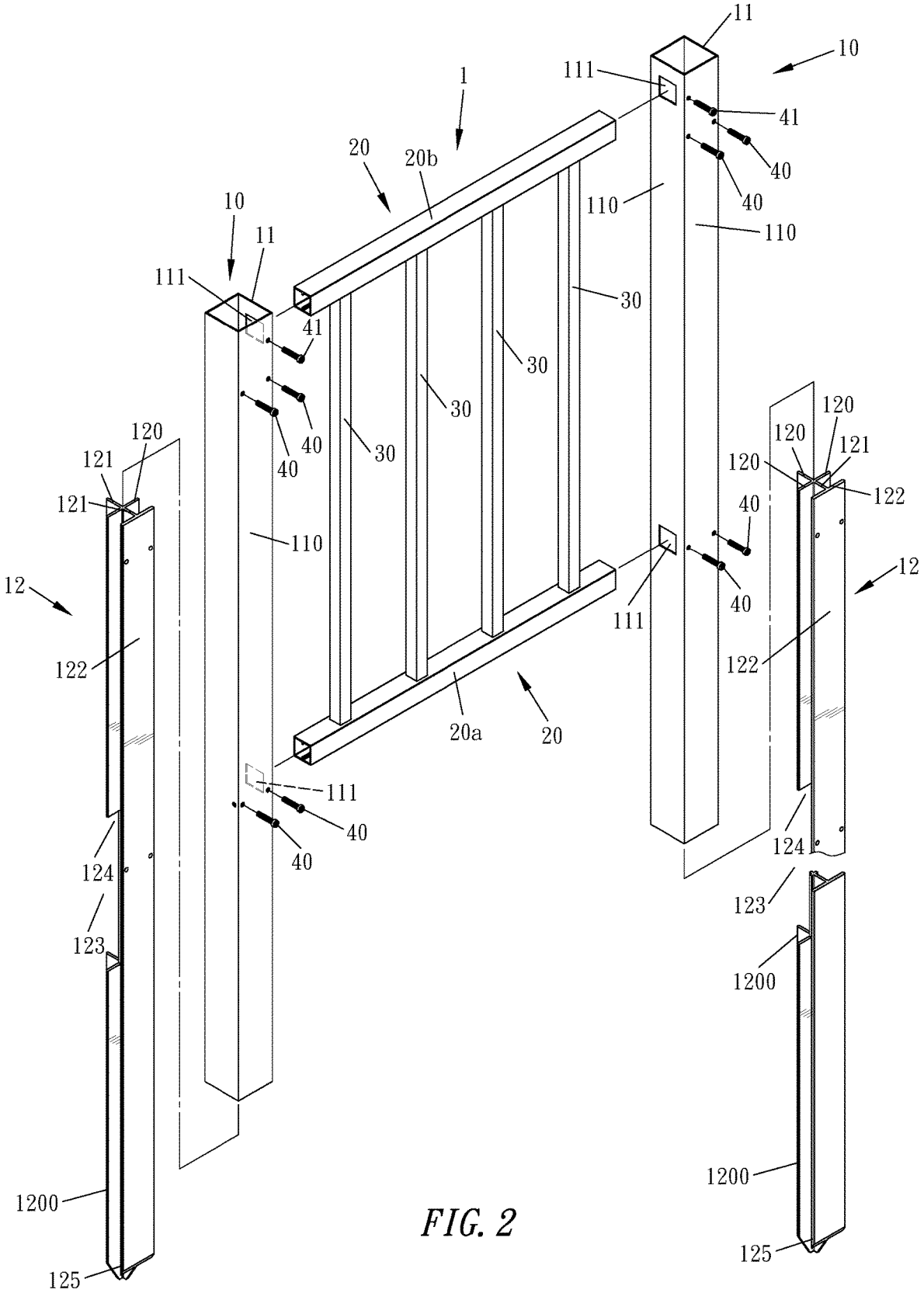
FIG. 2 is an exploded view of a single fence according to an embodiment of the present invention.
Figure 3:
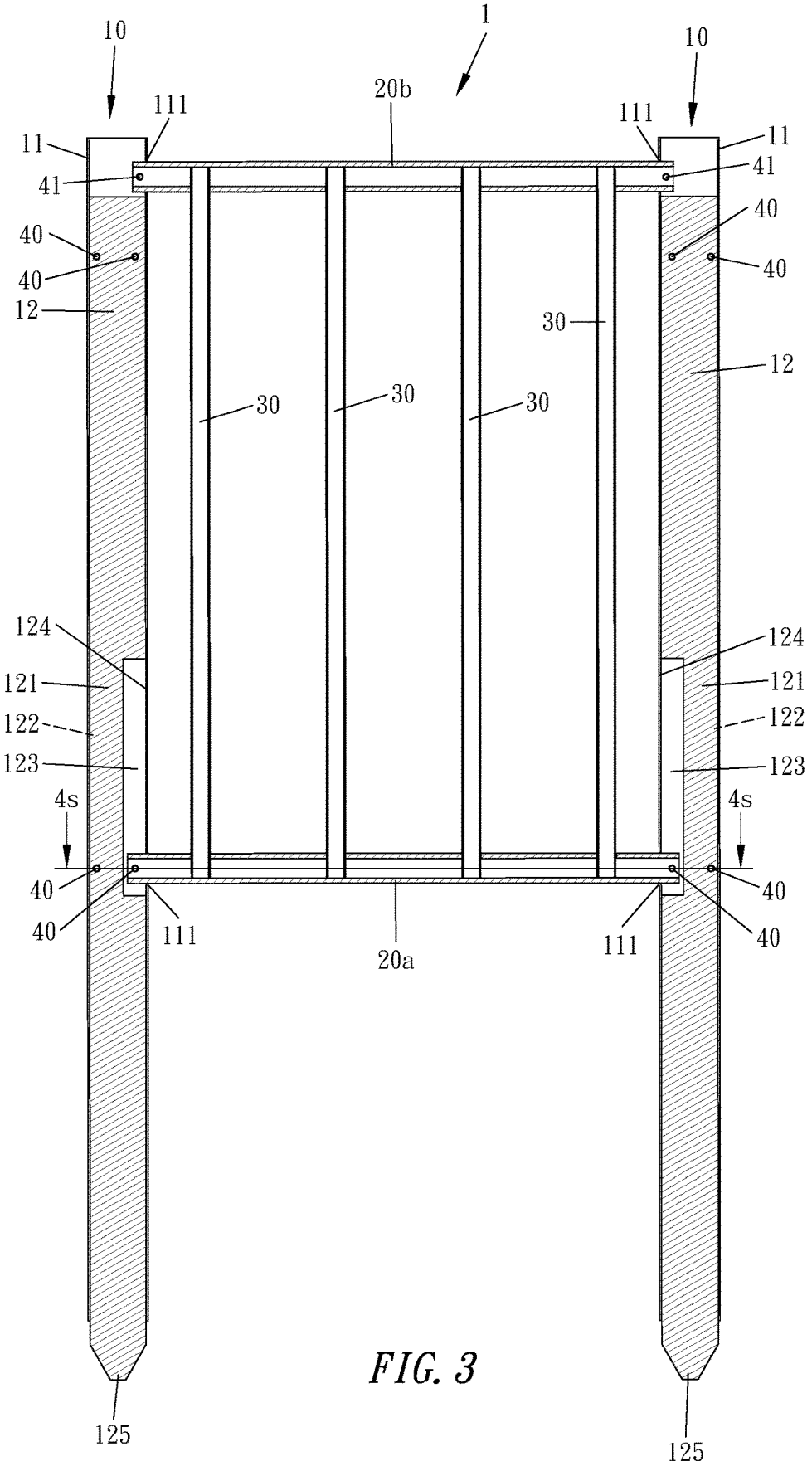
FIG. 3 is a sectional view of the combination of a single fence according to an embodiment of the present invention.

With reference to FIGS. 1~3, the fence 1 is shown on an embodiment of the present invention and each fence unit comprises two side posts 10, at least two cross bars 20 connected between the left and right side posts 10, and a plurality of vertical bars 30 connected between the cross bars 20 arranged up and down.

Figure 4:
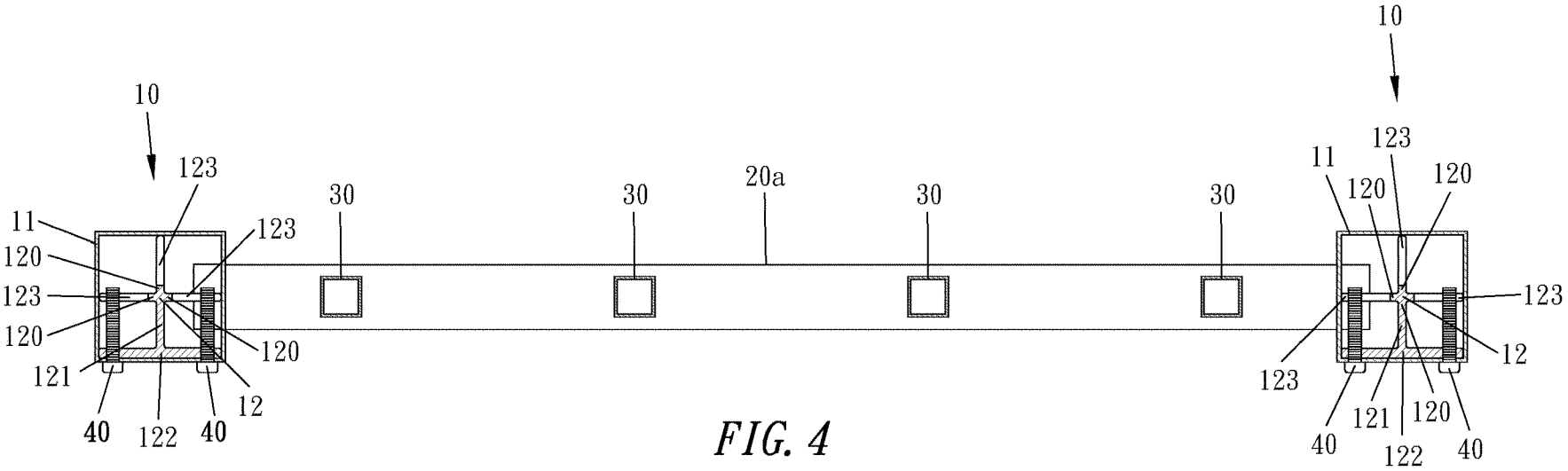
FIG. 4 is a sectional top view of the 4s-4s section line of FIG. 3.

Each side post 10 (as shown in FIG. 2) comprises a square side post tube 11 and a reinforcing post 12 defined inside the side post tube 11. The side post tube 11 is a hollow shape, and the tube wall 110 at the position where connecting to the cross bars 20 is configured with the connecting holes 111 to provide the end portion of the cross bar 20 to pass into the side post tube 11 through the connecting holes 111. The four sides of the reinforcing post 12 facing the side post tube 11 are respectively configured with three longitudinal boards 120 and a connecting board 121 extending coaxially with the side post tube 11 and arranged radially, wherein a gap with 90 degrees is defined between the adjacent three longitudinal boards 120 and the connecting board 121. The outside end of the connecting board 121 is connected with an abutting board 122, wherein the abutting board 122 and the connecting board 121 are in a vertical connection, and the lateral board edges 1200 of the three longitudinal boards 120 and the outside board surface of the abutting board 122 contact with the inner walls of the side post tube 11 (as shown in FIG. 4), thereby reinforcing the rigidity of the side post tube 11. The board edges of each longitudinal board 120 at the position facing the connecting holes on the each side post wall 110 of the side post tube 11 (excluding the connecting hole 111 located on the uppermost position of the side post tube 11) is configured with a notch 123 longer than the hole height of the connecting hole 111 and a gap 124 of the notch 123 faces the connecting hole 111. The bottom end of the reinforcing post 12 is configured with a cone part 125 exposed out of the bottom end of the side post tube 11, which can be hammered into the soils and fixed while installing the fence 1.

Figure 5:
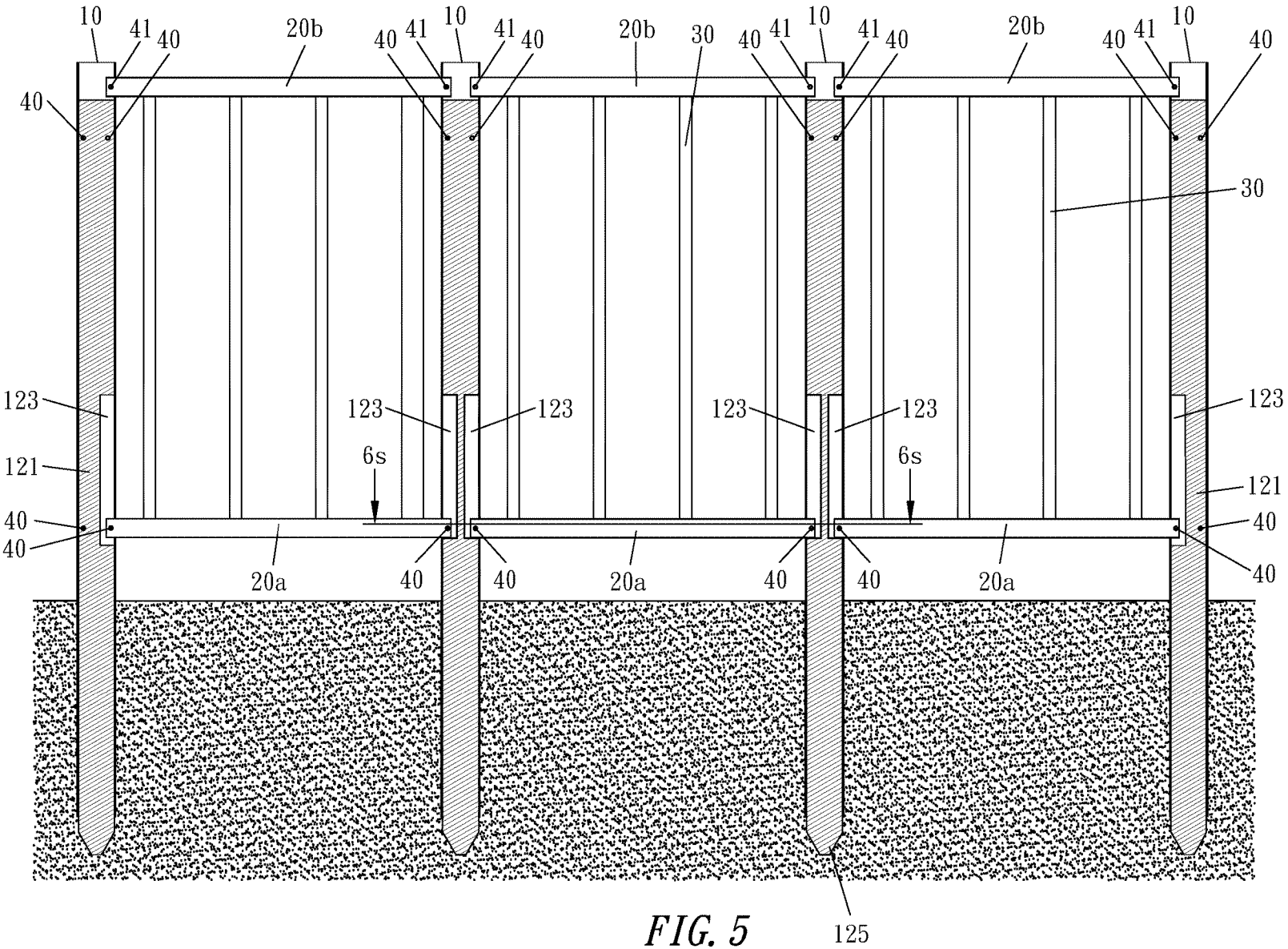
FIG. 5 is a front view of the combination of the multiple fence units in linear connection according to an embodiment of the present invention.
Figure 6:
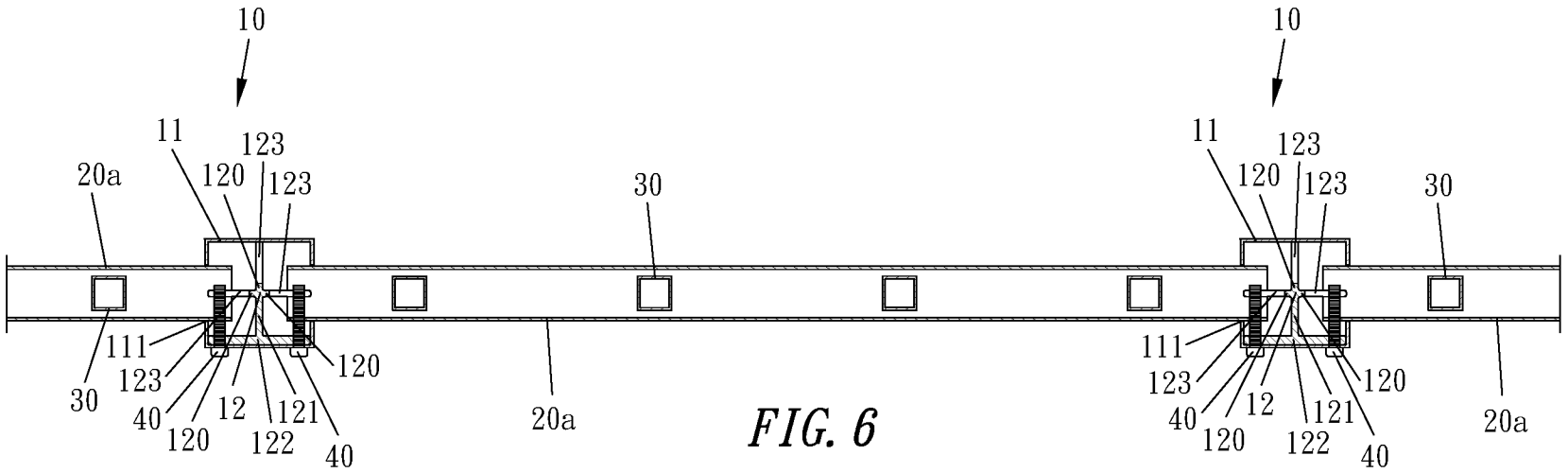
FIG. 6 is a sectional top view of the 6s-6s section line of FIG. 5.
Figure 7:
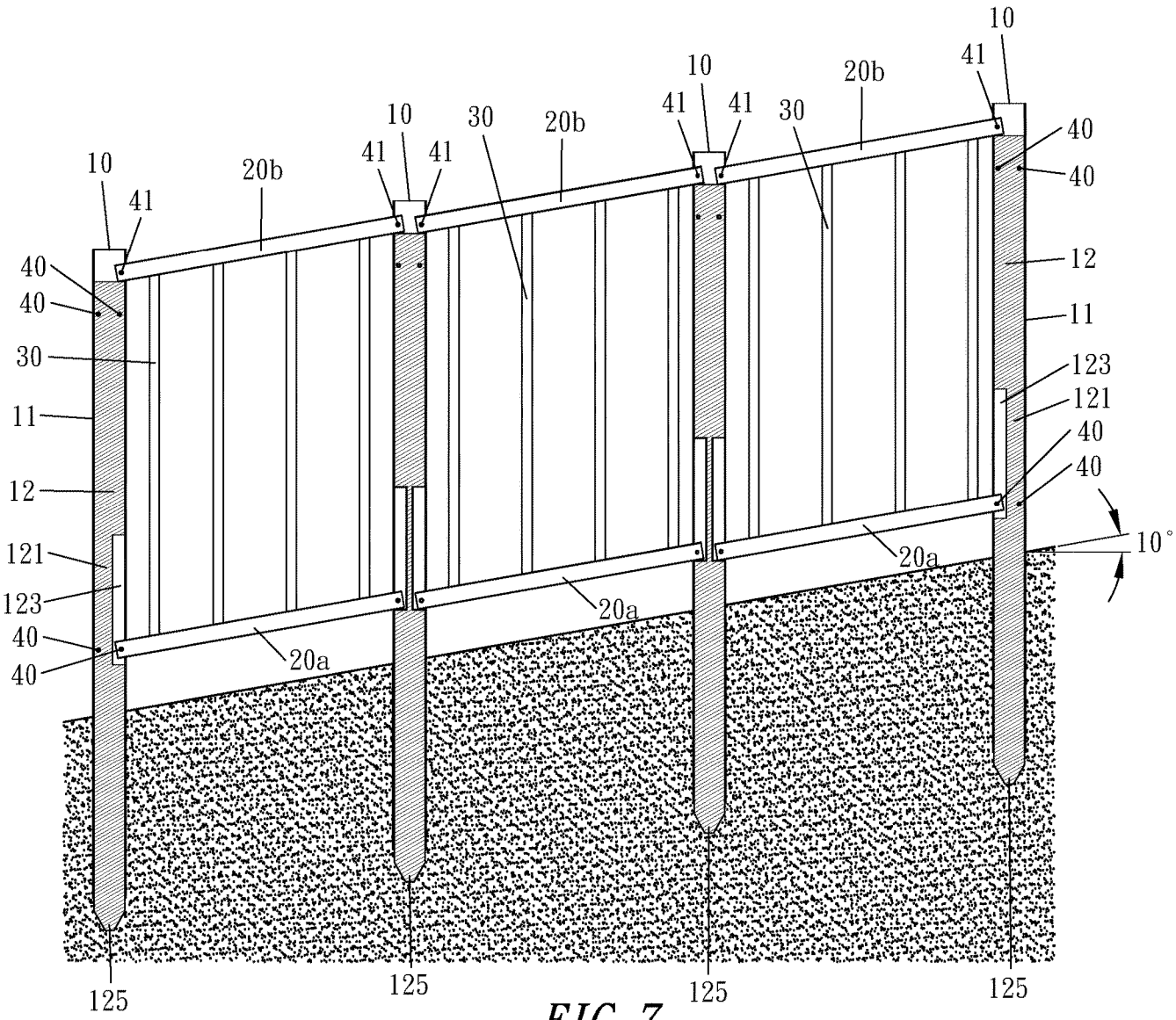
FIG. 7 is a sectional view of an embodiment of the present invention applied on a clinoform.

When installing and assembling the fence 1, firstly the cone part 125 at the bottom end of the reinforcing post 12 is hammered into the soils, the side post tube 11 is further sleeved outside the reinforcing post 12 and configured in a manner of the notch 123 corresponding to the connecting hole 111, afterwards, the two ends of the cross bar 20 located below (defined as a lower cross bar 20*a*) are respectively passing into the notch 122 through the connecting hole 111 and the gap 123, and then, a fixing component 40 (such as a screw) is utilized to pass through the abutting board 122 and lower cross bar 20*a* from the outside of the side post tube 11 to fix and combine the reinforcing post 12 and the side post tube 11 to be a complete side post 10, and meanwhile fixing the lower cross bar 20*a*. Furthermore, another fixing component 41 is utilized to fix the cross bar 20 located above (defined as an upper cross bar 20*b*) with the side post tube 11 from the outside of the side post tube 11, thereby connecting the upper cross bar 20*b*, the lower cross bar 20*a* and the side post 10, as shown in FIGS. 3 and 4. The multiple fences 1 are in a linear arrangement combination as shown in FIGS. 5 and 6, and thus, the two longitudinal boards 120 at an interval of 180 degrees can be used to connect and assemble to become a linear arrangement fences 1. When the installation site of the fence 1 is a slope, the end of the cross bar 20 will bend inside the notch 122 according to the change of ground surface and the upper and lower angles of the cross bar 20 will be changed (as shown in FIG. 7) because the internal height of the notch 122 is higher than the height of the connecting hole 111, thereby enabling the installation of the fence 1 not to be affected by the surface condition of the ground.

Figure 8:
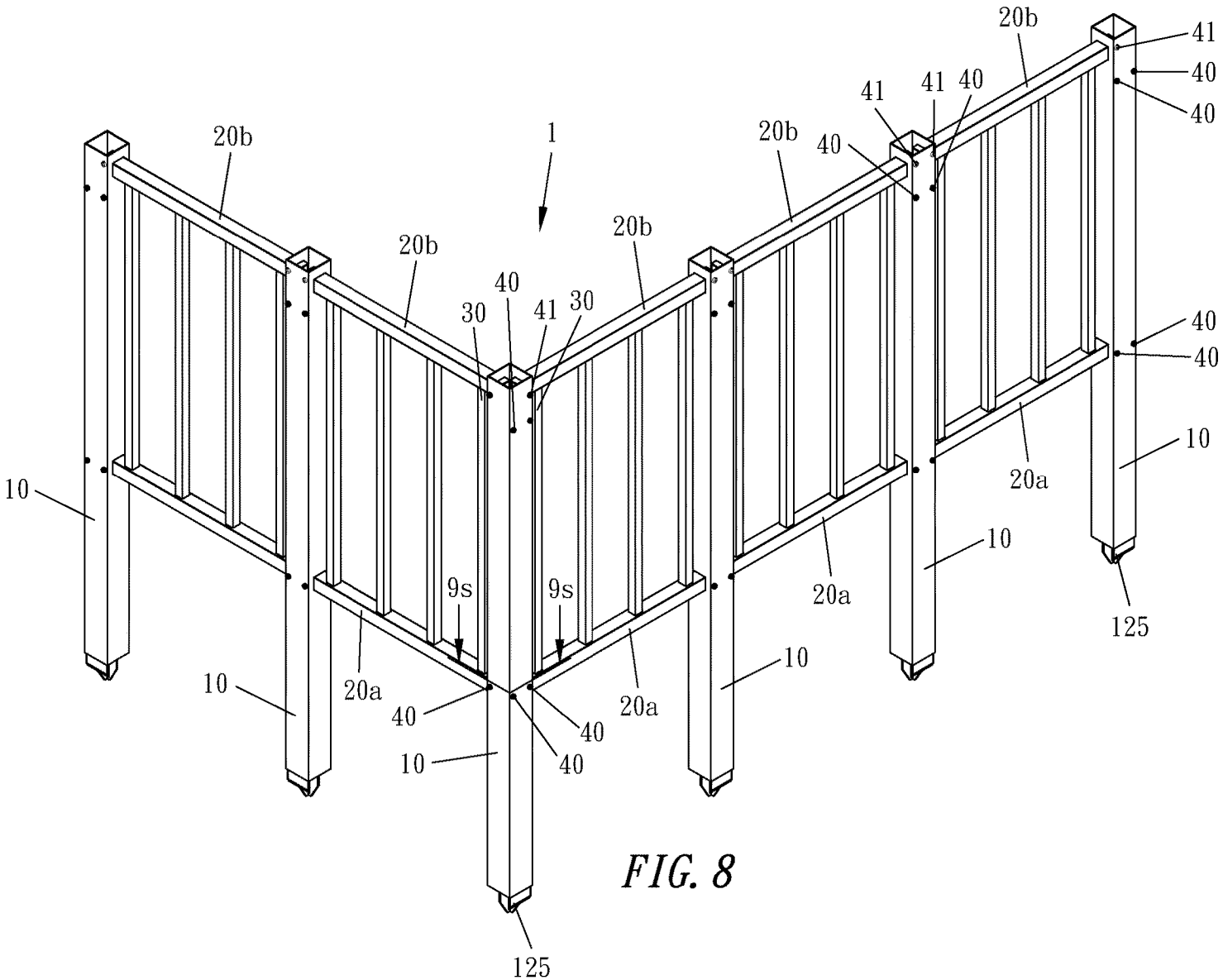
FIG. 8 is a perspective view of the combination of the fence in right-angle connection according to an embodiment of the present invention.
Figure 9:
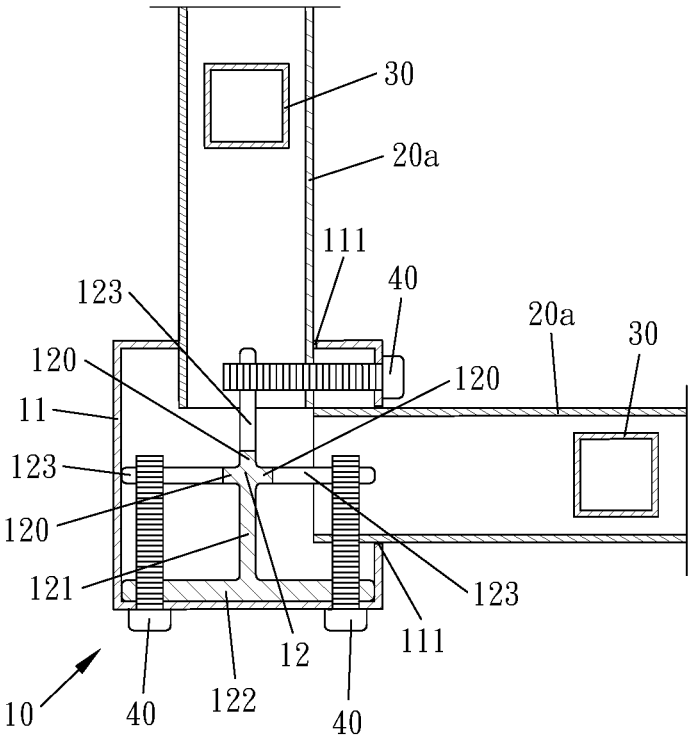
FIG. 9 is a sectional top view of the 9s-9s section line of FIG. 9.
Figure 10:
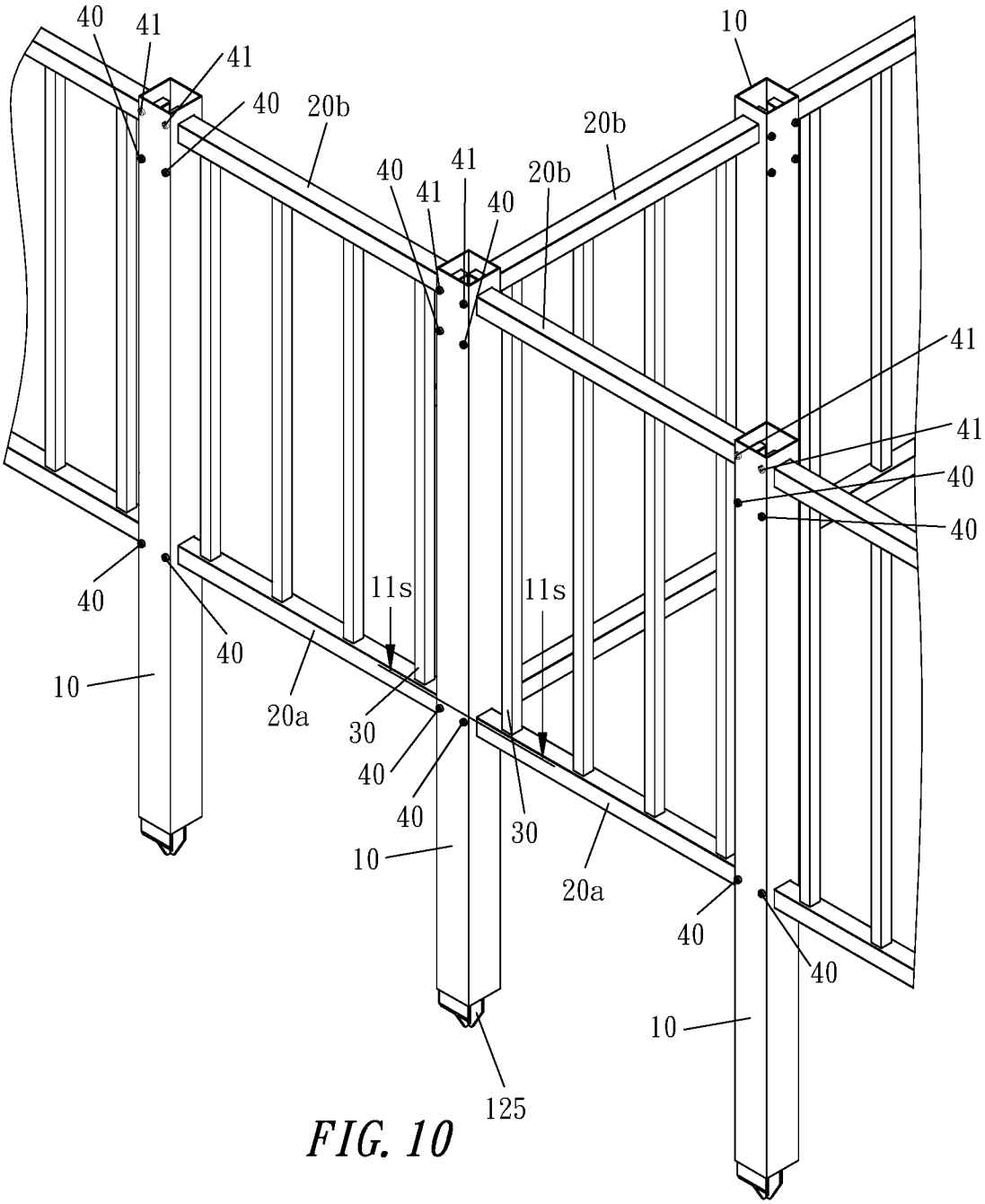
FIG. 10 is a perspective view of the combination of the fence in T-shaped connection according to an embodiment of the present invention.
Figure 11:
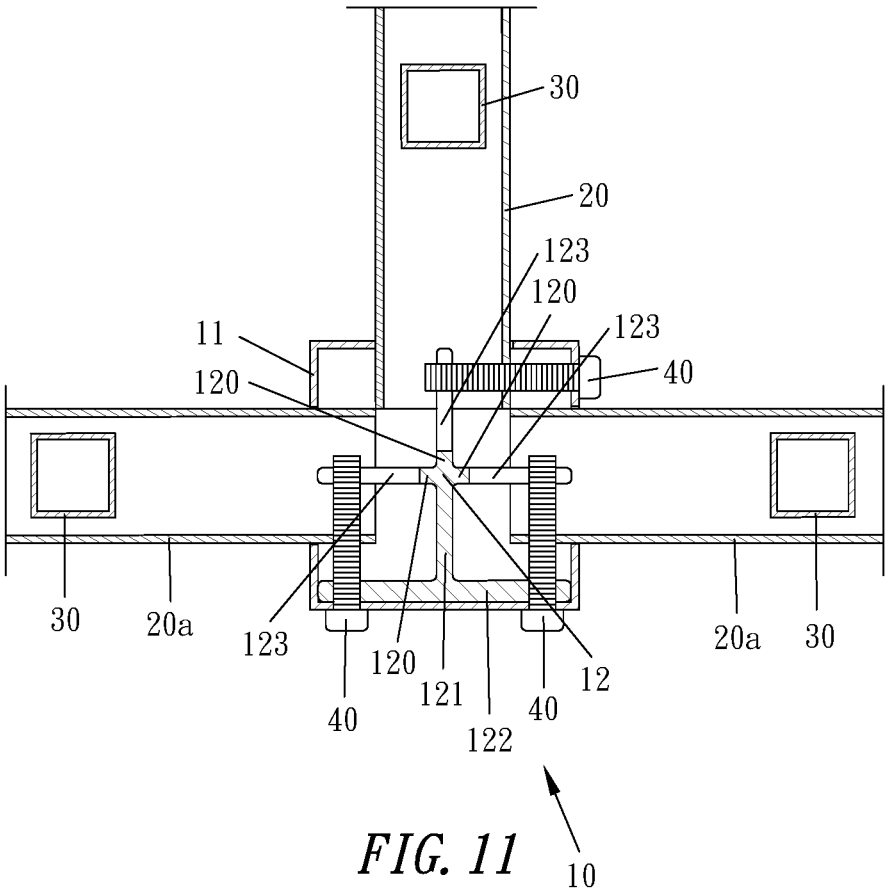
FIG. 11 is a sectional top view of the 11s-11s section line of FIG. 8.

Further as shown in FIGS. 8 and 9, the structural views are related to the fences 1 arranged and installed at right angle. In the embodiment of the present invention, the three longitudinal boards 120 of the reinforcing post 12 are respectively adjacent and spaced at 90 degrees and respectively configured with a notch 123, and thus the two longitudinal boards 120 spaced at 90 degrees can be used for the connection of the lower cross bar 20*a* to enable the two fences 1 to be in a right-angle bending arrangement, as shown in FIGS. 8 and 9 and further, as shown in FIGS. 10 and 11. The three longitudinal boards 120 are respectively connected with a lower cross bar 20*a* to enable the fence 1 to be assembled in a T-shaped and the fence 1 are allowed to be assembled according to the demands.

It can be seen from the foregoing description that the present invention has the following advantages and effects in application.

1. The reinforcing post 12 are provided with the three longitudinal boards 120 and an abutting board 122 and the lateral board edges 1200 of the longitudinal boards 120 and the outside board surface of the abutting board 122 contact with the internal wall of the side post tube 11, and the abutting board 122 is fixed with the side post tube 11 via the fixing components 40, thereby reinforcing the rigidity of the side post tube 11 to enable the structural strength of the side post tube 10 to be good.
2. The three longitudinal boards 120 of the reinforcing post 12 of the present invention are respectively spaced at 90 degrees, and the board edge 1200 of each longitudinal board 120 is respectively configured with a notch 123, and thus, the side post 10 can be used to connect the fences 1 in the linear, right-angle or T-shaped arrangement.

In summary, the present invention meets the requirements of novelty, inventiveness and practical applicability, and therefore an application for patent is hereby filed according to the law. Your examination and approval will be highly appreciated.

What is claimed is:

1. A structural improvement of a side post of a fence, comprising:

a square side post tube and a reinforcing post located inside the side post tube, the side post tube being in a hollow shape and an upper cross bar and a lower cross bar at a position where a tube wall connecting to the fence being provided with a connecting hole for end portions of the upper cross bar and the lower cross bar to pass into the side post tube through the connecting hole;

four side tube walls of the reinforcing post facing the side post tube being respectively configured with three longitudinal boards and a connecting board extending coaxially with the side post tube and being in a radial arrangement and the three longitudinal board and the connecting board being adjacent and spaced at 90 degrees;

an outside end of the connecting board connected with an abutting board, the abutting board vertically connected with the connecting board, lateral board edges of the longitudinal boards and an outside board surface of the abutting board contacting with an internal wall of the side post tube and the abutting board being fixed with the side post tube via a fixing component; and, the board edge of each longitudinal board being configured with a notch at a position corresponding to the connecting hole which the lower cross bar passing into, a hole height of the notch being higher than a hole height of the connecting hole, and a gap of the notch facing the connecting hole.

2. The structural improvement of the side post of the fence of claim 1, wherein the two longitudinal boards spaced at a 180-degree angle are respectively connected with the lower cross bar for assembling the fences in a linear arrangement.

3. The structural improvement of the side post of the fence of claim 1, wherein the two longitudinal boards spaced at a 90-degree angle are respectively connected with the lower cross bar for assembling the fences in a right-angle arrangement.

4. The structural improvement of the side post of the fence of claim 1, wherein the three longitudinal boards are respectively connected with the lower cross bar for assembling the fences in a T-shaped arrangement.

5. The structural improvement of the side post of the fence of claim 1, wherein a bottom end of the reinforcing column is configured with a cone part exposed out of the bottom end of the side post tube.

6. The structural improvement of the side post of the fence of claim 1, wherein the end portion of the lower cross bar is inserted into the side post tube and then fixed via the fixing component.

* * * * *